US011701676B2

(12) United States Patent
Donnelly et al.

(10) Patent No.: US 11,701,676 B2
(45) Date of Patent: Jul. 18, 2023

(54) TRIGGER SPRAYER ASSEMBLY WITH DUAL ACTION PISTON

(71) Applicants: Market Ready, Inc., Round Lake Park, IL (US); Cupcake LLC, New York, NY (US)

(72) Inventors: Brandon Donnelly, New York, NY (US); Milan-Bob Patadlas, Talisay (PH)

(73) Assignees: Market Ready, Inc., Round Lake Park, IL (US); Cupcake LLC, New York, NY (US)

( * ) Notice: Subject to any disclaimer, the term of this patent is extended or adjusted under 35 U.S.C. 154(b) by 0 days.

(21) Appl. No.: 17/841,312

(22) Filed: Jun. 15, 2022

(65) Prior Publication Data

US 2022/0401984 A1 Dec. 22, 2022

Related U.S. Application Data

(60) Provisional application No. 63/212,972, filed on Jun. 21, 2021.

(51) Int. Cl.
*B05B 11/10* (2023.01)

(52) U.S. Cl.
CPC ..... *B05B 11/1088* (2023.01); *B05B 11/103* (2023.01); *B05B 11/1011* (2023.01); *B05B 11/1035* (2023.01)

(58) Field of Classification Search
CPC ..... B05B 11/1088; B05B 11/1028–103; B05B 11/1035; B05B 11/1009–1011
See application file for complete search history.

(56) References Cited

U.S. PATENT DOCUMENTS 2,856,863 A * 10/1958 Henry ..... B05B 11/1015 417/560
3,927,834 A * 12/1975 Tada ..... B05B 11/106 251/114

(Continued)

FOREIGN PATENT DOCUMENTS

AU 2011248959 1/2013
AU 2012253503 1/2014

(Continued)

OTHER PUBLICATIONS

PCT/US2022/033730, International Search Report and Written Opinion dated Sep. 21, 2022, 13 pages.

*Primary Examiner* — Paul R Durand
*Assistant Examiner* — Randall A Gruby
(74) *Attorney, Agent, or Firm* — Andrus Intellectual Property Law, LLP

(57) ABSTRACT

A trigger sprayer includes an engine with a piston chamber and an outlet fluid passage, and a piston that slides within the piston chamber and defines an interior bellows chamber. The bellows component is movable in the interior bellows chamber between an uncompressed position in which a fluid volume in the interior bellows chamber is minimized and a compressed position in which the fluid volume is maximized. The trigger sprayer further includes a trigger lever that pivots between a neutral position and an actuated position using a pair of S-shaped trigger springs. Pivotal movement of the trigger lever pushes the piston vertically in the piston chamber to drive fluid from the piston chamber into the interior bellows chamber and move the bellows component from the uncompressed position to the compressed position. Relaxation of the bellows component drives fluid from the interior bellows chamber to the outlet fluid passage.

20 Claims, 10 Drawing Sheets

(56) References Cited

U.S. PATENT DOCUMENTS

| | | | | |
|---|---|---|---|---|
| 4,109,832 | A * | 8/1978 | Kutik | B05B 11/0044 222/332 |
| 4,146,155 | A * | 3/1979 | Kutik | B05B 11/1074 222/189.11 |
| 4,191,313 | A | 3/1980 | Blake et al. | |
| 4,222,501 | A | 9/1980 | Hammett et al. | |
| 4,225,060 | A * | 9/1980 | Kutik | B05B 11/1074 222/189.1 |
| 4,241,853 | A | 12/1980 | Pauls et al. | |
| 4,489,861 | A | 12/1984 | Saito et al. | |
| 4,591,077 | A * | 5/1986 | Corsette | B05B 11/1004 222/335 |
| 5,092,495 | A | 3/1992 | Andre | |
| 5,114,052 | A | 5/1992 | Tiramani et al. | |
| 5,462,208 | A | 10/1995 | Stahley et al. | |
| 6,279,784 | B1 | 8/2001 | O'Neill | |
| 8,602,269 | B2 | 12/2013 | Alluigi | |
| D698,660 | S | 2/2014 | Maas et al. | |
| 8,905,271 | B2 | 12/2014 | Maas et al. | |
| 9,714,133 | B2 | 7/2017 | Maas et al. | |
| D830,194 | S | 10/2018 | Maas et al. | |
| 10,456,798 | B2 | 10/2019 | Maas et al. | |
| 10,537,906 | B2 | 1/2020 | Maas et al. | |
| 11,471,902 | B2 * | 10/2022 | Byun | A45D 34/00 |
| 11,519,394 | B2 * | 12/2022 | Bauer | F04B 9/14 |
| 2011/0000805 | A1 | 5/2011 | Maas et al. | |
| 2012/0048959 | A1 | 3/2012 | Maas et al. | |
| 2012/0199662 | A1 | 8/2012 | Maas et al. | |
| 2012/0286057 | A1 | 11/2012 | Maas et al. | |
| 2013/0112766 | A1 | 7/2013 | Maas et al. | |
| 2015/0008267 | A1 | 1/2015 | Maas et al. | |
| 2017/0333930 | A1 | 11/2017 | Maas et al. | |
| 2018/0185864 | A1 | 7/2018 | Maas et al. | |
| 2020/0298262 | A1 | 9/2020 | Maas et al. | |
| 2020/0360948 | A1 | 11/2020 | Maas et al. | |
| 2020/0406277 | A1 | 12/2020 | Bauer et al. | |
| 2021/0001361 | A1 | 1/2021 | Burmann et al. | |

FOREIGN PATENT DOCUMENTS

| | | |
|---|---|---|
| AU | 2017203729 | 6/2017 |
| AU | 2012312279 | 10/2017 |
| AU | 2018200446 | 2/2018 |
| AU | 2019226241 | 9/2019 |
| AU | 2020201143 | 3/2020 |
| BR | 112012028247 | 5/2011 |
| CN | 103068493 | 4/2013 |
| CN | 103619489 | 3/2014 |
| CN | 103930219 | 7/2014 |
| EP | 2707149 | 3/2014 |
| EP | 2566629 | 3/2021 |
| JP | 2014519969 | 8/2014 |
| JP | 2014527911 | 10/2014 |
| JP | 2019115904 | 7/2019 |
| MX | 2012012821 | 1/2013 |
| MX | 2013013043 | 11/2014 |
| MX | 2014003378 | 1/2015 |
| MX | 2019011344 | 11/2019 |
| RU | 2577264 | 3/2016 |
| RU | 2683982 | 4/2019 |
| WO | 2011139383 | 11/2011 |
| WO | 2012061764 | 5/2012 |
| WO | 2012154886 | 11/2012 |
| WO | 2013043938 | 3/2013 |

* cited by examiner

TRIGGER SPRAYER ASSEMBLY WITH DUAL ACTION PISTON

CROSS-REFERENCE TO RELATED PATENT APPLICATION

The application claims the benefit of U.S. Provisional Application Ser. No. 63/212,972, filed Jun. 21, 2021, which is incorporated by reference herein in its entirety.

FIELD

The present disclosure relates to an improved trigger sprayer assembly with a dual action piston that provides a continuous or extended spray of fluid.

BACKGROUND

Trigger sprayer assemblies provide a convenient way to manually dispense many household products and commercial cleaners in a stream, spray, mist, or foam discharge through the actuation of a trigger lever. In some cases, the trigger sprayer assembly may be configured to provide a continuous or extended spray in which fluid is emitted from the trigger sprayer assembly for a certain amount of time after actuation of the trigger lever has ceased. Existing continuous spray trigger assemblies are generally quite large as compared with other trigger sprayer assemblies, as continuous spray trigger assemblies often require secondary reservoirs to store the fluid that is discharged during the extended spray period, as well as means for pressurizing that fluid. An improved trigger sprayer assembly that provides extended spray in an space-optimized package would therefore be useful.

SUMMARY

The present invention is directed to a trigger sprayer assembly for dispensing a continuous or extended spray or stream of fluid. The trigger sprayer includes an engine with a piston chamber and an outlet fluid passage that is fluidly coupled to the piston chamber, a piston that is slidably disposed within the piston chamber, where the piston defines an interior bellows chamber, and a bellows component disposed within the interior bellows chamber. The bellows component is movable between an uncompressed position in which an available fluid volume in the interior bellows chamber is minimized and a fully compressed position in which the available fluid volume in the interior bellows chamber is maximized. The trigger sprayer further includes a trigger lever coupled to the engine and the piston using a pair of S-shaped trigger springs, where the trigger lever is configured to pivot between a neutral position and an actuated position. Pivotal movement of the trigger lever from the neutral position to the actuated position pushes the piston vertically in the piston chamber to drive fluid from the piston chamber into the interior bellows chamber and move the bellows component from the uncompressed position to a partially or fully compressed position. Fluid is driven from the interior bellows chamber to the outlet fluid passage when the trigger lever is squeezed, and after it is released relaxation of the bellows component from the compressed position to the uncompressed position continues to drive fluid from the interior bellows chamber to the outlet fluid passage.

According to another embodiment of the present invention, a trigger sprayer assembly for dispensing continuous or extended spray or stream of a fluid includes an engine with a piston chamber and a piston valve configured to control unidirectional fluid flow through the piston from the piston chamber to the interior bellows chamber. The trigger sprayer includes a piston that is slidably disposed within the piston chamber and defines an interior bellows chamber; and a bellows component disposed within the interior bellows chamber. The bellows component is movable between an uncompressed position in which an available fluid volume in the interior bellows chamber is minimized and a fully compressed position in which the available fluid volume in the interior bellows chamber is maximized. The trigger sprayer further includes a trigger lever coupled to the engine and the piston, where the trigger lever is configured to pivot between a neutral position and an actuated position, an input valve configured to control unidirectional fluid flow from the inlet portion to the piston chamber, a piston valve configured to control unidirectional fluid flow from the piston chamber to the interior bellows chamber, and an output valve configured to control unidirectional fluid flow through the outlet portion. Pivotal movement of the trigger lever from the neutral position to the actuated position pushes the piston vertically in the piston chamber to drive fluid from the piston chamber through the piston valve into the interior bellows chamber and move the bellows component from the uncompressed position to a compressed position. Fluid is driven from the interior bellows chamber to the outlet fluid passage when the trigger lever is squeezed, and after it is released relaxation of the bellows component from the compressed position to the uncompressed position continues to drive fluid from the interior bellows chamber to the outlet portion and through the output valve.

In another aspect, the present invention is a method of dispensing fluid from a trigger sprayer assembly, which enables continuous or extended spraying. The method includes pulling a trigger lever toward a rear end of the trigger sprayer assembly, where the trigger lever pushes a piston vertically in a piston chamber to drive fluid from the piston chamber through a piston valve into an interior bellows chamber formed in the piston. In response to pulling the trigger lever, a bellows component disposed in the interior bellows chamber moves from an uncompressed position to a compressed position. The method further includes releasing the trigger lever toward a front end of the trigger sprayer assembly. In response to releasing the trigger lever, the bellows component relaxes from the compressed position to the uncompressed position to drive fluid from the interior bellows chamber to an outlet fluid passage.

BRIEF DESCRIPTION OF THE DRAWINGS

The present invention is described with reference to the following Figures. The same numbers are used throughout the Figures to reference like features and like components.

DETAILED DESCRIPTION

Figure 1:
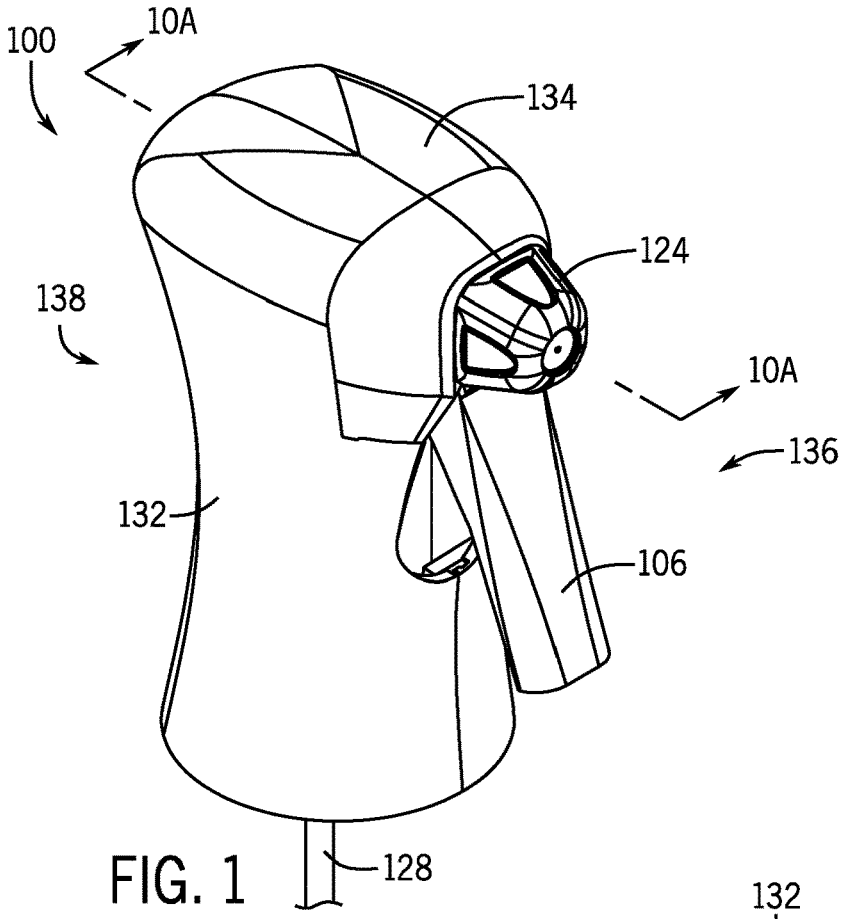
FIG. 1 is a perspective view of a trigger sprayer assembly according to an exemplary embodiment of the present invention.
Figure 2:
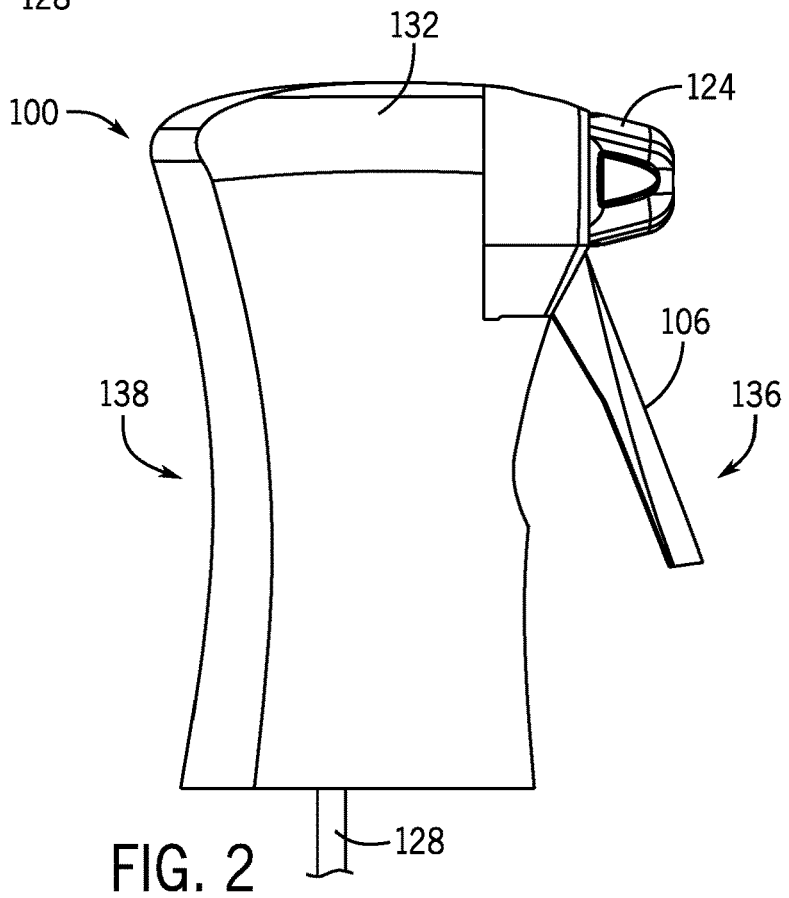
FIG. 2 is a side view of the trigger sprayer assembly of FIG. 1.
Figure 3:
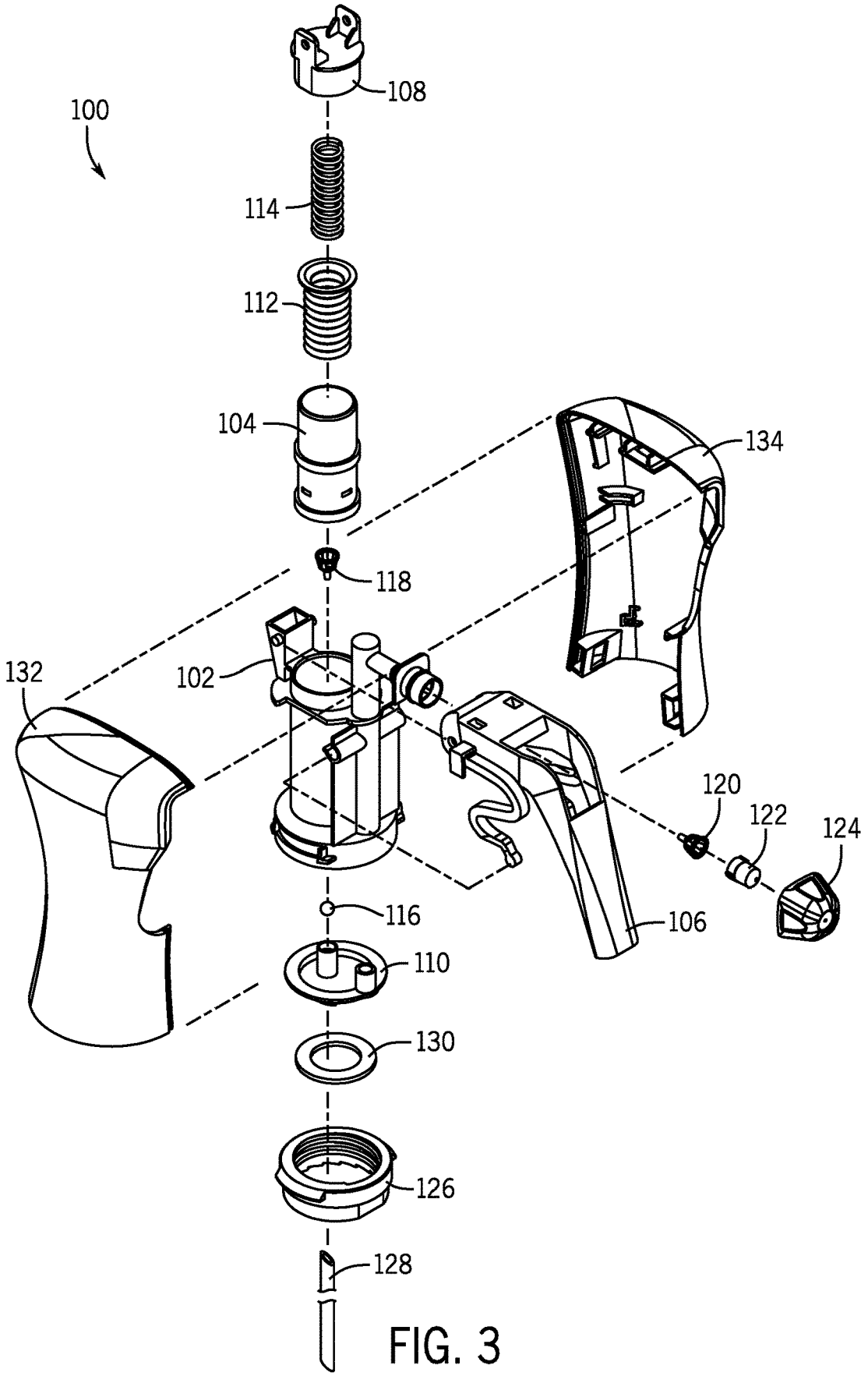
FIG. 3 is an exploded view of the trigger sprayer assembly of FIG. 1.

FIGS. 1-3 depict an improved trigger sprayer assembly 100 according to an exemplary embodiment of the present invention. The trigger sprayer assembly 100 may be adapted to dispense a fluid (e.g., cleaning products, industrial products, water, cosmetics, food products) housed within a bottle or container (not shown) in a stream, spray, or mist dispensing pattern. To operate the sprayer assembly 100, a user grips a trigger component 106 at a front end 136 of the assembly 100, positioning a thumb on a shroud 132, 134 at a rear end 138 of the assembly 100. By depressing or squeezing the trigger component 106 toward the rear end 138 from a relaxed or neutral position to a depressed or actuated position, fluid from the bottle or container is driven out through a nozzle 124. In some embodiments, the nozzle 124 is configured to rotate relative to the shroud components 132, 134 to permit a user to close or open a fluid passage that terminates at the nozzle 124, and to select a desired dispensing pattern (e.g., stream, spray, mist).

Referring specifically to the exploded view depicted in FIG. 3, the internal components of the trigger sprayer assembly 100 are shown. These internal components include an engine 102 with a piston chamber and a fluid outlet passage (e.g., piston chamber 500, fluid outlet passage 502, 504 described in further detail below with reference to FIG. 5D), and a piston 104 that is coupled to the trigger lever 106 using a piston coupler 108. The piston 104 is configured to slide in vertical direction within the piston chamber.

As the trigger lever 106 is depressed toward the rear end 138 of the assembly 100, the piston component 104 is forced downwardly by the trigger component 106 within the piston chamber formed in the engine 102. This decreases the available fluid volume of the piston chamber and forces fluid within the piston chamber through a one-way piston valve 118 and upwardly into an interior chamber within the piston component 104. A resilient bellows component 112 and a bellows spring 114 are positioned within the interior chamber and are compressed by the fluid flowing through the one-way piston valve 118 into the interior chamber. As it compresses the bellows component 112 and the bellows spring 114, the fluid also flows out of the piston component 104, into a fluid outlet passage within the engine 102 and out through the nozzle 124, provided that the nozzle 124 is rotated to an opened position.

When the actuating force has been removed and the trigger component 106 relaxes toward the front end 136, the trigger component 106 pulls the piston 104 upwardly within the piston chamber, thereby increasing the volume of the piston chamber and drawing a supply of fluid into the piston chamber. At the same time, relaxation of the bellows component 112 and the bellows spring 114 from their compressed position continues to force fluid out of the piston component 104 and into the fluid outlet passage within the engine 102. In this way, a continuous or extended spray is achieved even after the user is not actively actuating the trigger lever 106. Further details regarding the specific steps in the actuation of trigger sprayer assembly 100 are included below with reference to FIGS. 10A-10D.

Still referring to FIG. 3, an input housing 110 is shown to be positioned below the engine 102. The input housing 110 may be configured to couple to a dip tube 128 that extends into the bottle or container of fluid (not shown) and provides a path for the fluid to be drawn upwards into the sprayer assembly 100. The input housing 110 also provides a seat for a one-way input valve 116 that regulates a flow of fluid into the engine 102. As shown, in an exemplary embodiment, the one-way input valve 116 is a ball valve, although other types of one-way valves may be utilized.

A neck closure 126 is shown to be positioned below the input housing 110 and the one-way input valve 116. The neck closure 126 is configured to be utilized to couple the engine 102 to any desired bottle or container. As such, the dimensions of the neck closure (e.g., height, outer diameter, inner diameter) may be variable based on the size and shape of the bottle or container housing the liquid to be dispensed. In an exemplary implementation, the neck closure 126 includes threads and is configured to be threadably coupled to a neck portion of the bottle or container. In other implementations, the neck closure 126 is coupled to a neck portion of the bottle or container using a snap fit assembly process. A sealing gasket 130, shown positioned below the neck closure 126, may be utilized to ensure that fluid does not seep between the engine 102 and the input housing 110, and out through the neck closure 126, particularly in the case if the trigger sprayer assembly 100 is tilted or inverted.

The internal components of the trigger sprayer assembly 100 are also shown to include an output or nozzle valve 120 and a water jacket 122. The nozzle valve 120, like the input valve 116 and the piston valve 118, may be a one-way valve that is configured to only permit the passage of fluid once a fluid pressure threshold is exceeded. Further details regarding the output valve 120 are included below with reference to FIGS. 10A-10D. The water jacket 122 may be configured to sit adjacent to the nozzle valve 120 and prevent the leakage of fluid at the joint between the engine 102 and the nozzle component 124, particularly in a case in which the trigger sprayer assembly 100 is tilted or positioned such that the nozzle component 124 faces downwardly.

In an exemplary embodiment, the bellows component 112, the piston valve 118, and the nozzle valve 120 are fabricated from a thermoplastic elastomer (TPE) using an injection molding process. TPE exhibits many properties advantageous to valves in contact with a variety of fluids, including high abrasion resistance, high fatigue resistance, high elasticity, chemical resilience, and low compression set. In other embodiments, one or more of the bellows component, the piston valve 118, and the nozzle valve 120 may be fabricated from a different material, for example, liquid silicone rubber, or using a different manufacturing process.

Figure 4A:
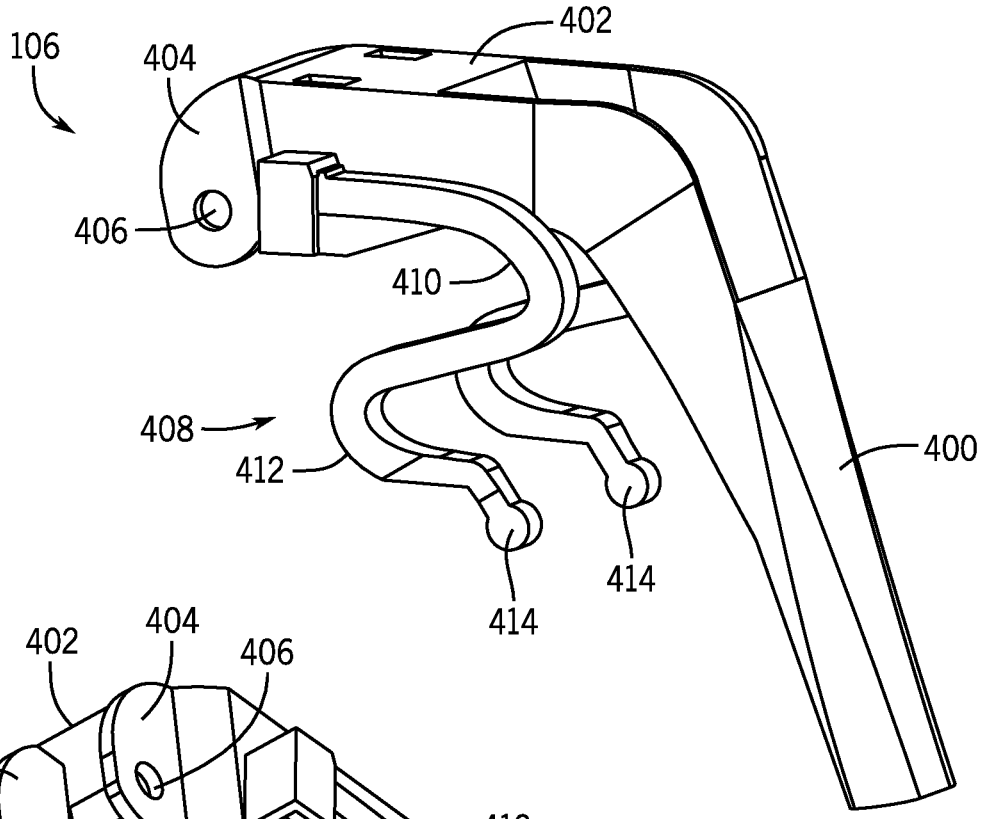
FIG. 4A is a perspective view of a trigger component used in the trigger sprayer assembly of FIG. 1.
Figure 4B:
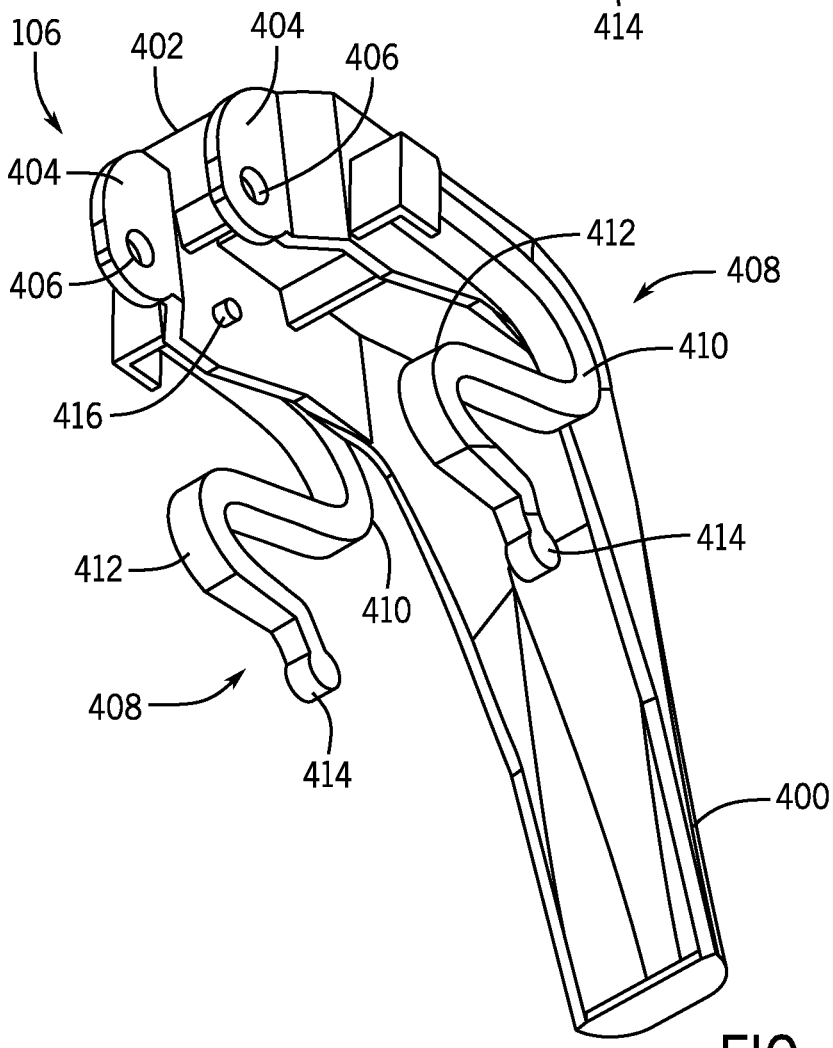
FIG. 4B is another perspective view of the trigger component of FIG. 4A.

Referring now to FIGS. 4A and 4B, perspective views of the trigger lever component 106 are shown. The trigger lever component 106 is shown to include a main trigger body 402 with a lever grip portion 400 and a pair of S-shaped springs 408 extending therefrom. The springs 408 are configured to be compressed as a user exerts an actuating force on the lever grip portion 400 and the trigger lever 106 is moved from the neutral position to the depressed position. When a user releases the actuating force, the potential energy stored in the springs 408 causes the trigger component 106 to return to the neutral position. Since the piston 104 is coupled to the trigger lever 106, the return of the trigger 106 to the neutral position pulls the piston 104 upwardly within the piston chamber, permitting fluid to be drawn upwardly through the dip tube 128 to fill the piston chamber in preparation for subsequent actuation of the trigger lever 106.

Each of the S-shaped springs 408 includes a first curved portion 410, a second curved portion 412, and a ball-shaped terminating portion 414. The first curved portion 410 extends from the main trigger body 402 towards the lever grip portion 400, while the second curved portion 412 extends from the first curved portion 410 in the opposite direction. Existing springs for trigger sprayer assemblies are generally U-shaped, having either a generally convex or concave shape, but not both. The present inventors have recognized that S-shaped trigger springs with both concave and convex portions are less susceptible to fatigue damage and provide a smoother actuation feeling to the user. In the exemplary embodiment, the first curved portion 410 has a larger radius of curvature than the second curved portion 412 such that the first curved portion 410 compresses more easily than the second curved portion 412. As described in further detail below with reference to FIGS. 5A, 5B, and 10A, the terminating portions 414 of the springs 408 may be inserted in receiving regions (e.g., spring sockets 518) formed in the engine 102 such that the ball-shaped terminating portions 414 are constrained in the vertical direction, but are unconstrained to pivot within the receiving regions. In an exemplary embodiment, the springs 408 are coupled to the main trigger body 402 using a living hinge, and installation of the terminating portions 414 into the receiving regions may include pivoting the springs 408 relative to the main trigger body 402 along the living hinge.

The trigger lever component 106 is further shown to include a pair of pivot flanges 404 extending rearwardly from the main trigger body 402 opposite the lever grip portion 400. The pivot flanges 404 include pivot recesses 406 formed therethrough that are configured to receive pivot pins extending from the engine 102 (e.g., pivot pins 514, depicted in FIGS. 5A and 5B) such that the coupling of the pivot pins and pivot recesses 406 act as a pivot point for the trigger component 106 to rotate relative to engine 102. In other embodiments, the coupling of the pins and recesses may be reversed, such that the pivot flanges 404 include pins configured to fit within recesses formed in the engine 102.

Other coupling features on the trigger component 106 include a pair of piston coupling pins 416 (depicted in FIG. 4B) extending into an interior region of the main trigger body 402. The piston coupling pins 416 are configured to be received by recesses (e.g., piston coupling recesses 606, depicted in FIGS. 6A and 6B) formed in the piston coupler 108. Engagement of the piston coupling pins 416 within the recesses permits pivotal movement of the trigger lever 106 to be translated into linear movement of the piston 104 and piston coupler 108. As with the pivot recesses 406, in other embodiments, the coupling of the pins and recesses may be reversed, such that the piston coupling recesses are formed in the main trigger body 402 and the pins are located on the piston coupler 108.

FIGS. 5A-5D respectively depict perspective, bottom, and side cross-sectional views of the engine 102. The engine 102 is shown to include a vertically-oriented piston chamber 500 with a vertically-oriented fluid outlet chamber 502 situated parallel to the piston chamber 500. As specifically depicted in FIG. 5D, a piston outlet 522 is utilized to fluidly couple the piston chamber 500 to the outlet chamber 502. The vertically-oriented fluid outlet chamber 502 is also shown to be fluidly coupled with a horizontally-oriented fluid outlet chamber 504. A nozzle flange 506 extends from the horizontally-oriented fluid outlet chamber 504 and provides a seat for mounting the output valve 120, the water jacket 122, and the rotatable nozzle 124.

Opposite the outlet chamber 504 and the nozzle flange 506, the engine 102 is shown to include a pivot wedge body 512 with a pair of opposing pivot pins 514 extending therefrom. The shape of the wedge body 512 may match the contours of the rear side of the shroud components 132, 134 (see FIGS. 10A-10D) such that the wedge body 512 provides structural support and prevents excessive flexure of the shroud components 132, 134 in the area where the shroud components 132, 134 are likely to be gripped by a user's thumb during actuation. The pivot recesses 406 formed in the pivot flanges 404 of the trigger lever 106 are configured to fit over the pivot pins 514 such that the trigger lever 106 can pivot relative to the engine 102 about the pivot pins 514. In an exemplary embodiment, the pivot flanges 404 are coupled to the pivot pins 514 using a snap fit assembly process.

Below the piston and outlet chambers 500, 502, the engine 102 is shown to include a neck coupling portion 508. The neck coupling portion 508 is generally cylindrical and has a larger outer diameter than the piston and outlet chambers 500, 502 combined. In an exemplary embodiment, the neck coupling portion 508 may include a pair of radial openings 510. When the neck coupling component 126 (see FIG. 3) is coupled to the engine 102, a pair of flanges located on the neck coupling component 126 may extend through the radial openings 510 to retain the neck coupling component 126 on the engine 102.

Situated above the neck coupling portion 508 and within the piston chamber 500, the engine 102 is shown to include a fluid input passage 524 and input valve capture prongs 520. The fluid input passage 524 provides a path for fluid to enter the engine 102 after traveling through the dip tube 128 and input housing 110 (see FIG. 10C). A valve seat for the input ball valve 116 may be provided in the input housing 110 (e.g., valve seat 810, see FIGS. 8B and 8C) and when the input housing 110 is coupled to the engine 102, the valve capture prongs 520 are situated above the input ball valve 116. When the fluid pressure within the dip tube 128 is sufficient to lift the ball valve 116 off of its seat in the input housing 110, the capture prongs 520 restrain the ball valve 116 from traveling into the piston chamber 500 while still permitting the flow of fluid into the piston chamber 500. In embodiments in which the input valve 116 is a different style of valve other than a ball valve (e.g., a resilient cross-slit or flap valve), the capture prongs 520 may be omitted from the engine 102.

Figure 5A:
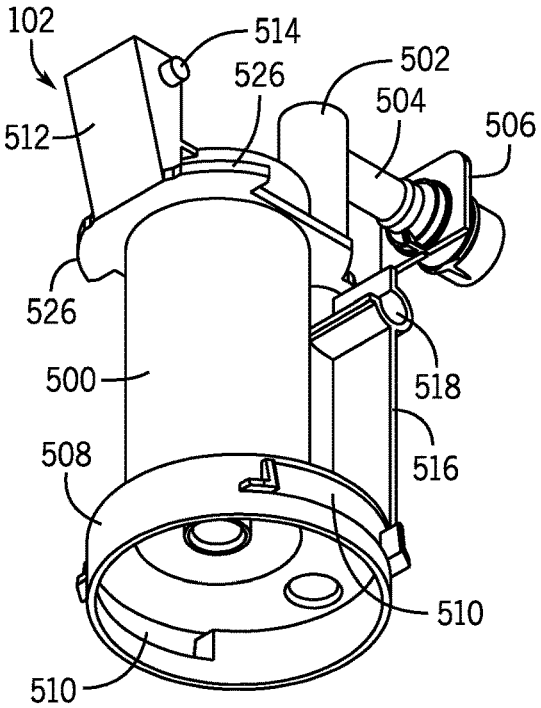
FIG. 5A is a perspective view of an engine component used in the trigger sprayer assembly of FIG. 1.
Figure 5B:
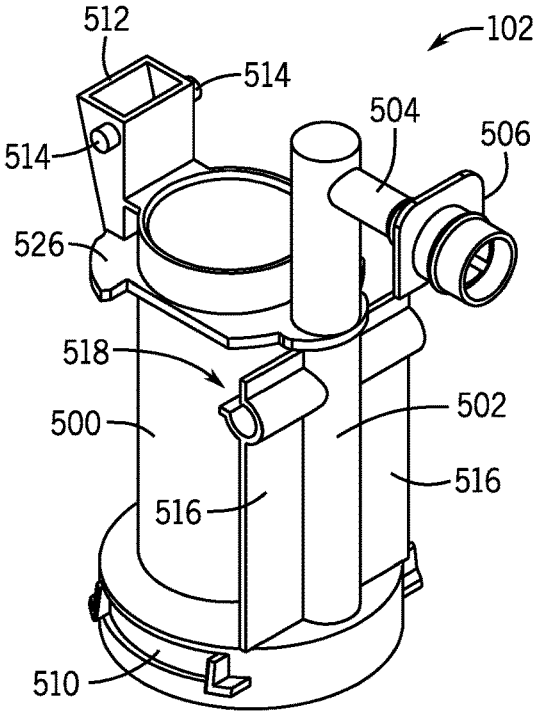
FIG. 5B is another perspective view of the engine component of FIG. 5A.
Figure 5C:
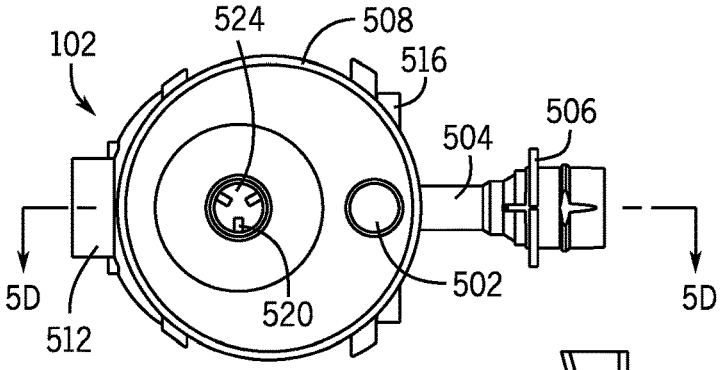
FIG. 5C is a bottom view of the engine component of FIG. 5A.
Figure 5D:
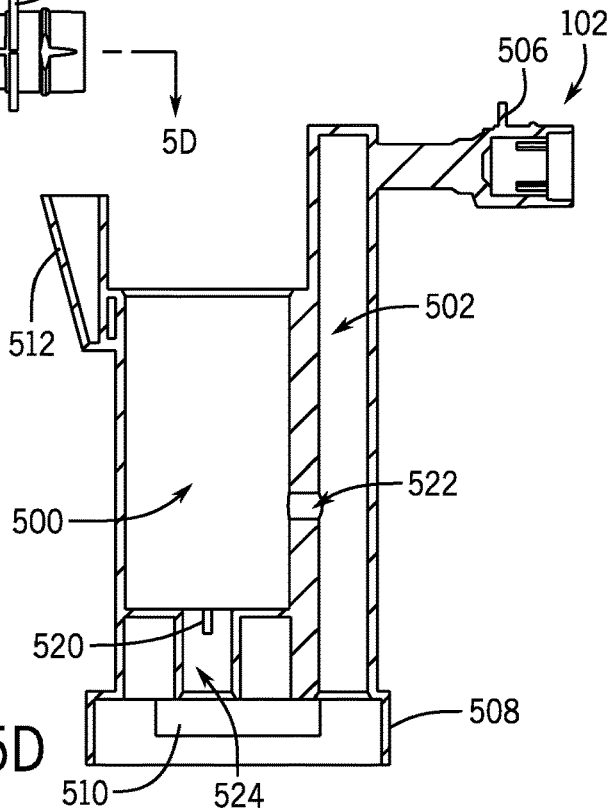
FIG. 5D is a side cross-sectional view of the engine component taken along the line 5D-5D of FIG. 5B.

Additional coupling features of the engine 102 include a pair of spring receiving recesses 518 positioned at the top of a strengthening rib 516 that extends outwardly from the vertically-oriented fluid outlet chamber 502. The spring receiving recesses 518 are configured to receive the terminating portions 414 of the trigger springs 408 (see FIGS. 4A and 4B) using a snap fit assembly process. Once coupled, the terminating portions 414 and the receiving recesses 518 may operate as a ball and socket joint to permit rotational movement of the trigger springs 408 relative to the engine 102 as the trigger springs 408 are compressed during actuation of the trigger lever 106. A pair of shroud alignment flanges 526, specifically depicted in FIGS. 5A and 5B, are shown to extend outwardly below the pivot wedge body 512. Each of the shroud alignment flanges 526 is configured to fit within a corresponding shroud jacket (shroud jackets 912, 914, see FIG. 9) when the shroud components 132, 134 are assembled to the engine 102 to ensure that the shroud components 132, 134 have proper vertical alignment relative to the engine 102.

Figure 6A:
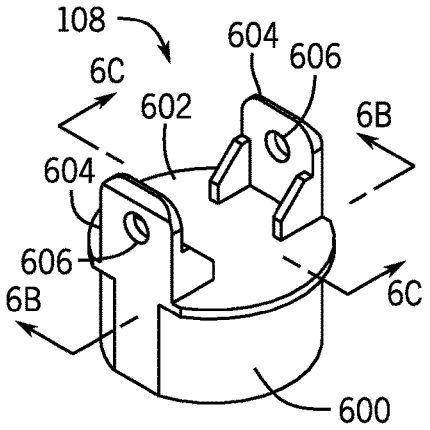
FIG. 6A is a perspective view of a piston coupler used in the trigger sprayer assembly of FIG. 1.
Figure 6B:
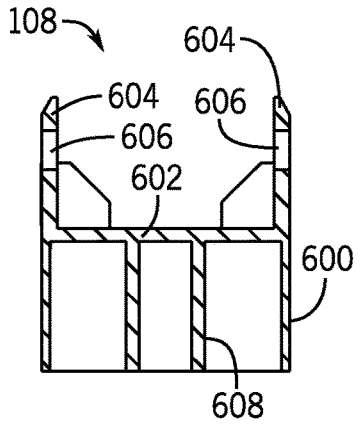
FIG. 6B is a side cross-sectional view of the piston coupler taken along the line 6B-6B of FIG. 6A.

Turning now to FIGS. 6A-6B, perspective and side cross-sectional views of the piston coupler 108 are depicted. The piston coupler 108 is shown to include a generally cylindrical sidewall 600 that terminates in an upper wall 602. A pair of opposing flanges 604 extend upwardly from the upper wall 602, each of the flanges 604 having a piston coupling recess 606 formed therethrough. As described above, the recesses 606 are configured to receive piston coupling pins 416 extending from the trigger lever 106.

Figure 6C:
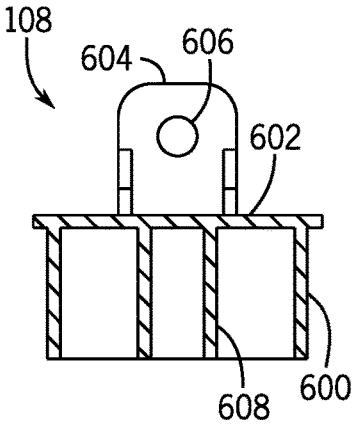
FIG. 6C is a side cross-sectional view of the piston coupler taken along the line 6C-6C of FIG. 6A.

The piston coupler 108 is further shown to include a bellows spring alignment body 608 (see FIGS. 6B and 6C) extending downwardly from the upper wall 602 within an interior region of the coupler 108 bound by the sidewall 600. A bellows spring (e.g., bellows spring 114, depicted in FIGS. 3 and 10A-10D) is configured to be inserted over the spring alignment body 608 during assembly of the trigger sprayer assembly 100. As described in further detail below with reference to FIGS. 10A-10D, the spring alignment body 608 ensures that the bellows spring compresses and relaxes along a vertical axis, thus preventing the bellows spring from skewing at an angle and damaging the bellows component.

Figure 7A:
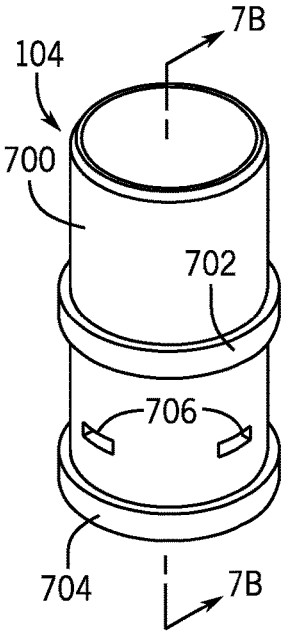
FIG. 7A is a perspective view of a piston used in the trigger sprayer assembly of FIG. 1.
Figure 7B:
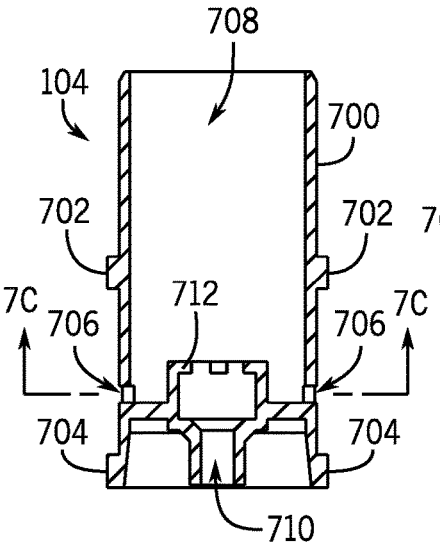
FIG. 7B is a side cross-sectional view of the piston taken along the line 7B-7B of FIG. 7A.
Figure 7C:
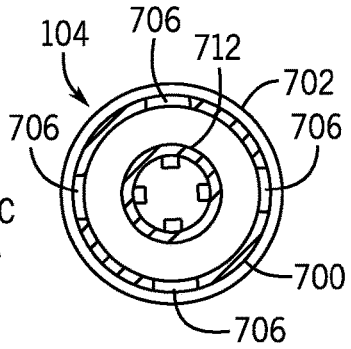
FIG. 7C is a bottom cross-sectional view of the piston taken along the line 7C-7C of FIG. 7B.

FIGS. 7A-7C depict perspective and cross-sectional views of the piston 104. The piston 104 is shown to include a generally cylindrical sidewall 700 with an upper flange 702 located at a vertical midpoint of the sidewall 700 and a lower flange 704 located at a lower end of the sidewall 700. Multiple piston outlets 706 are arranged in a radial patten near the lower flange 704 and are shown to extend through the sidewall 700. For example, in the exemplary embodiment depicted in FIGS. 7A-7C, the piston 104 includes four piston outlets 706 arranged equidistantly (i.e., 900 apart) from each other. In other embodiments, the piston 104 may include a greater or fewer number of piston outlets 706. When the piston 104 is inserted within the piston chamber 500 (see FIG. 10A), the upper and lower flanges 702, 704 form a generally water-tight seal against the sidewalls of the piston chamber 500. The arrangement ensures that all of the fluid exiting through the piston outlets 706 travels circumferentially about the piston sidewall 700 and through the piston outlet 522 formed in the engine 102 (see FIG. 5D).

The interior structure of the piston 104, specifically depicted in FIG. 7B, is shown to include an interior bellows chamber 708 situated above a piston inlet passage 710. The interior bellows chamber 708 and the piston inlet passage 710 are separated by a piston valve structure 712. When the piston valve (e.g., piston valve 118) is seated within the piston valve structure 712 in a closed position, the flow of fluid from the piston chamber 500 in the engine 102 into the bellows chamber 708 is arrested. However, when the fluid pressure within the piston chamber 500 is sufficient to lift the piston valve off of its seat in the piston valve structure 712 to move the piston valve to an opened position, fluid flows through the piston inlet passage 710 and the piston valve into the bellows chamber 708. Notably, all fluid that flows through the piston 104 must flow through the piston inlet passage 710 and into the bellows chamber 708 before exiting the piston 104 via one of the piston outlets 706.

Figure 8A:
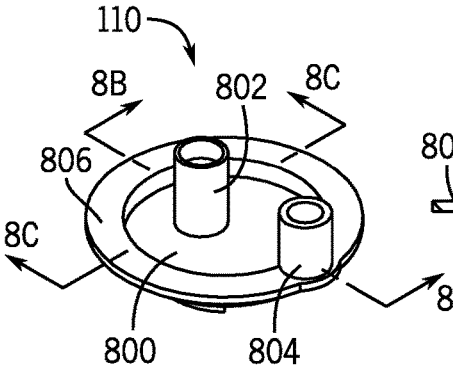
FIG. 8A is a perspective view of an input housing used in the trigger sprayer assembly of FIG. 1.
Figure 8B:
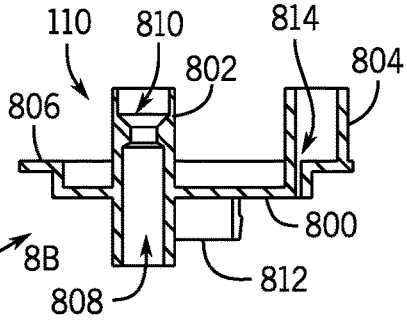
FIG. 8B is a side cross-sectional view of the input housing taken along the line 8B-8B of FIG. 8A.
Figure 8C:
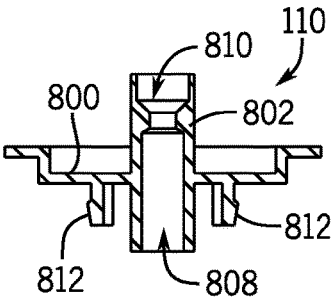
FIG. 8C is another side cross-sectional view of the input housing taken along the line 8C-8C of FIG. 8A.

Referring now to FIGS. 8A-8C, perspective and cross-sectional views of the input housing 110 are depicted. The input housing 110 is shown to include a disc-shaped main body 800 with a first cylindrical portion 802 and a second cylindrical portion 804. The first and second cylindrical portions 802, 804 are surrounded by a radial flange 806. The first cylindrical portion 802 includes a dip tube coupling portion 808. As shown in FIGS. 10A-10D, the dip tube 128 that extends into the fluid container is inserted into the dip tube coupling portion 808 to provide a path for the fluid to travel from the fluid container into the trigger sprayer assembly 100. The first cylindrical portion 802 is also shown to include a cup-shaped valve seat 810 for a ball valve (e.g., input valve 116) that is positioned at an upper end of the first cylindrical portion 802 opposite the dip tube coupling portion 808. Sufficient fluid pressure within the dip tube coupling portion 808 causes the ball valve to lift off of the valve seat 810, allowing fluid to pass through the valve seat 810 and enter the engine 102. The second cylindrical portion 804 is configured to be inserted into the vertically-oriented fluid outlet chamber 502 formed in the engine 102 (see FIGS. 10A-10D).

The second cylindrical portion 804 includes a drain passage 814 that permits excess fluid in the chamber 502 to drain back into the fluid container after actuation of the trigger lever 106 has ceased and the bellows component 112 has returned to a fully uncompressed position, resulting in an arresting of flow through the nozzle 124. The input housing 110 is also shown to include a pair of retaining prongs 812 extending below the main body 800. The retaining prongs 812 may be utilized to retain a sealing gasket (e.g., gasket 130, depicted in FIG. 3) against the main body 800, preventing leakage of fluid out of the engine 102 and input housing 110.

An exemplary process for assembling the trigger sprayer assembly 100 is as follows: the piston valve 118 is inserted into the piston valve structure 712 of the piston 104. The bellows spring 114 is inserted into the bellows 112, and both are inserted into the piston 104. The piston coupler 108 is assembled to the piston 104 using a snap fit assembly process, retaining the bellows 112 and bellows spring 114 within the piston 104.

The assembly process continues as the piston 104 is inserted into the piston chamber 500 of the engine 102. The trigger lever 106 is assembled to the engine by snapping the recesses 406 formed in the pivot flanges 404 of the trigger lever 106 over the pivot pins 514 extending from the wedge body 512 of the engine 102. To couple the trigger lever 106 to the piston 104 and ensure that actuation of the trigger lever 106 results in corresponding movement of the piston 104, the piston coupling pins 416 of the trigger lever 106 are inserted into piston coupling recesses 606 formed in the piston coupler 108. Next, the terminating portion 414 of each trigger spring 408 is inserted into the corresponding spring socket 518 in the engine 102.

From there, the input valve 116 is inserted into the valve seat 810 formed in the input housing 110. The input housing 110 is then coupled to the engine 102 by inserting the first cylindrical portion 802 of the input housing 110 into the fluid inlet passage 524 of the engine 102, and the second cylindrical portion 804 of the input housing 110 into the vertically-oriented fluid outlet chamber 502 of the engine 102. The seal gasket 130 is inserted over the retaining prongs 812 of the input housing 110, and the neck closure 126 is snap fit assembled the engine 102. To assemble the nozzle components of the trigger sprayer assembly 100, the nozzle valve 120 and the water jacket 122 are inserted into the horizontally-oriented fluid outlet chamber 504 of the engine 102. The nozzle component 124 is seated against the nozzle flange 506 to retain the nozzle valve 120 and the water jacket 122 within the engine 102.

The final steps of the assembly process include coupling the shroud components 132 and 134 to each other and the engine 102, as described in further detail below with reference to FIG. 9. The dip tube 128 is inserted into the dip tube coupling portion 808, and a fluid bottle or container is coupled to the neck closure 126. In an exemplary embodiment, one or more of the assembly steps detailed above is performed using pneumatic robotic devices to insert and coupled various components to each other. Advantageously, several steps in the assembly method involve moving multiple components along parallel horizontal or vertical axes, movements which are well-suited to assembly using robotic devices.

Figure 9:
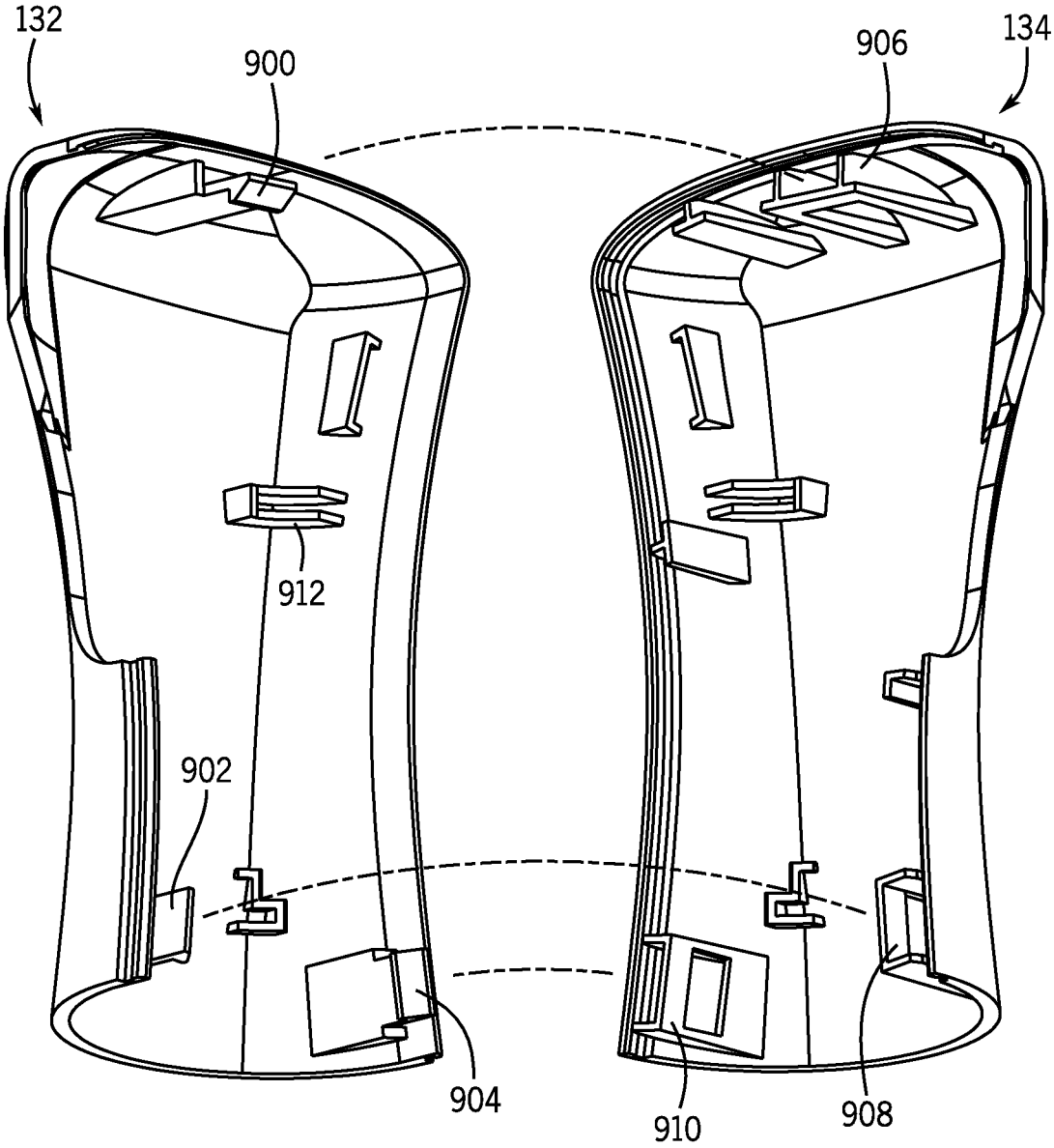
FIG. 9 is a perspective view depicting the coupling of the shroud components used in the trigger sprayer assembly of FIG. 1.

FIG. 9 depicts the coupling of the shroud components 132 and 134. The right shroud component 132 is shown to include an upper prong 900, a front lower prong 902, and a rear lower prong 904. Prongs 900-904 are configured to correspondingly fit within upper recess structure 906, lower front recess structure 908, and lower front recess structure 910 formed in the left shroud component 134 to retain the shroud components 132, 134 in a coupled position.

In addition to the retention features 900-910, the shroud components 132, 134 are also shown to include various features that support and align the assembly, including jackets 912 and 914. As described above with reference to FIGS. 5A and 5B, the jackets 912, 914 may be configured to fit around the shroud alignment flanges 526 to align the engine 102 relative to the shroud components 132, 134. In an exemplary embodiment, the shroud components 132, 134 use a double seam design for press fitting.

Figure 10A:
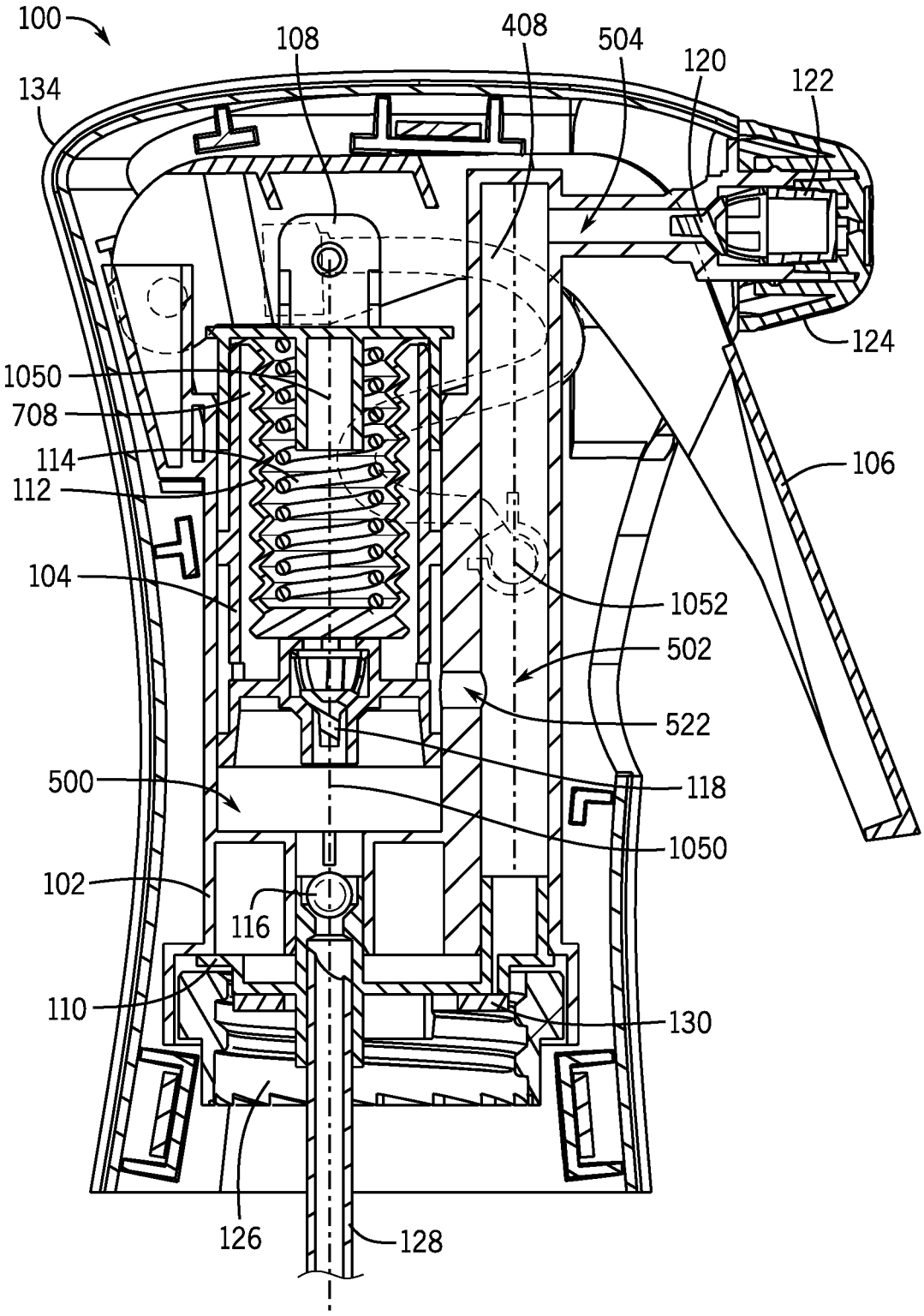
FIG. 10A is a side cross-sectional view of the trigger sprayer assembly taken along the line 10A-10A of FIG. 1.
Figure 10B:
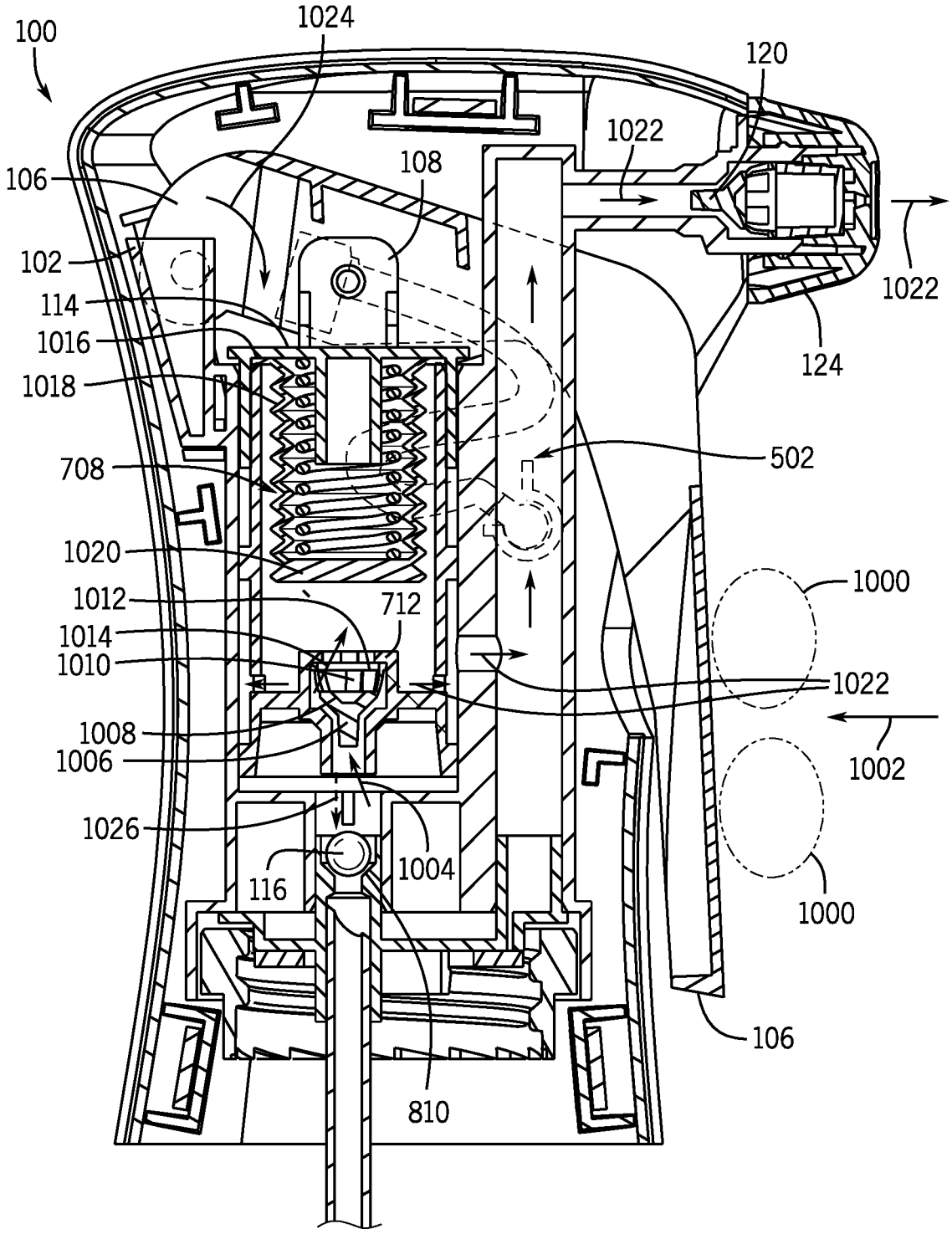
FIG. 10B is another side cross-sectional view of the trigger sprayer assembly depicting a flow of fluid as a trigger component moves from a neutral position to a depressed position.
Figure 10C:
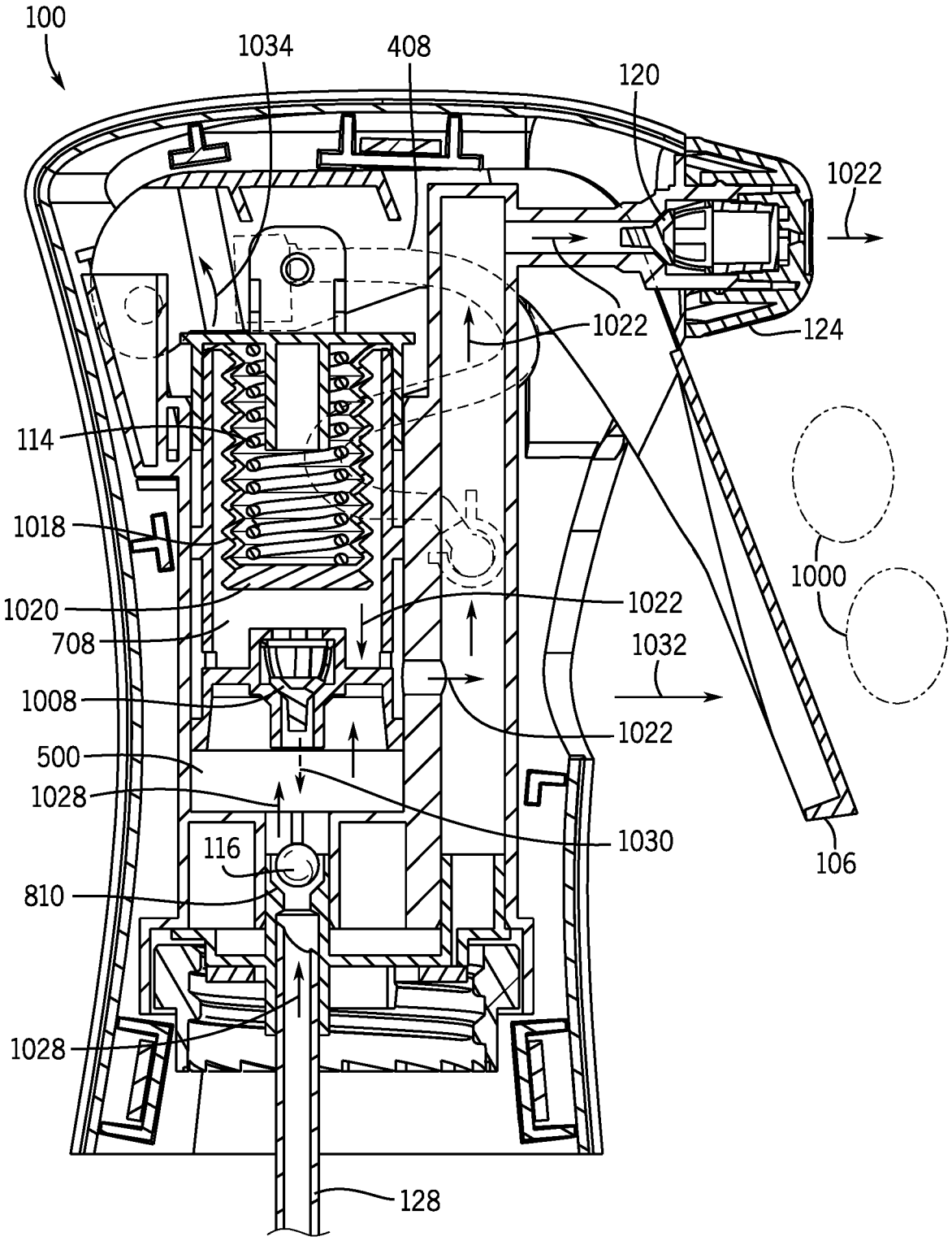
FIG. 10C is another side cross-sectional view of the trigger sprayer assembly depicting a flow of fluid as the trigger component moves from the depressed position to the neutral position and the bellows component is partially relaxed from a compressed position.
Figure 10D:
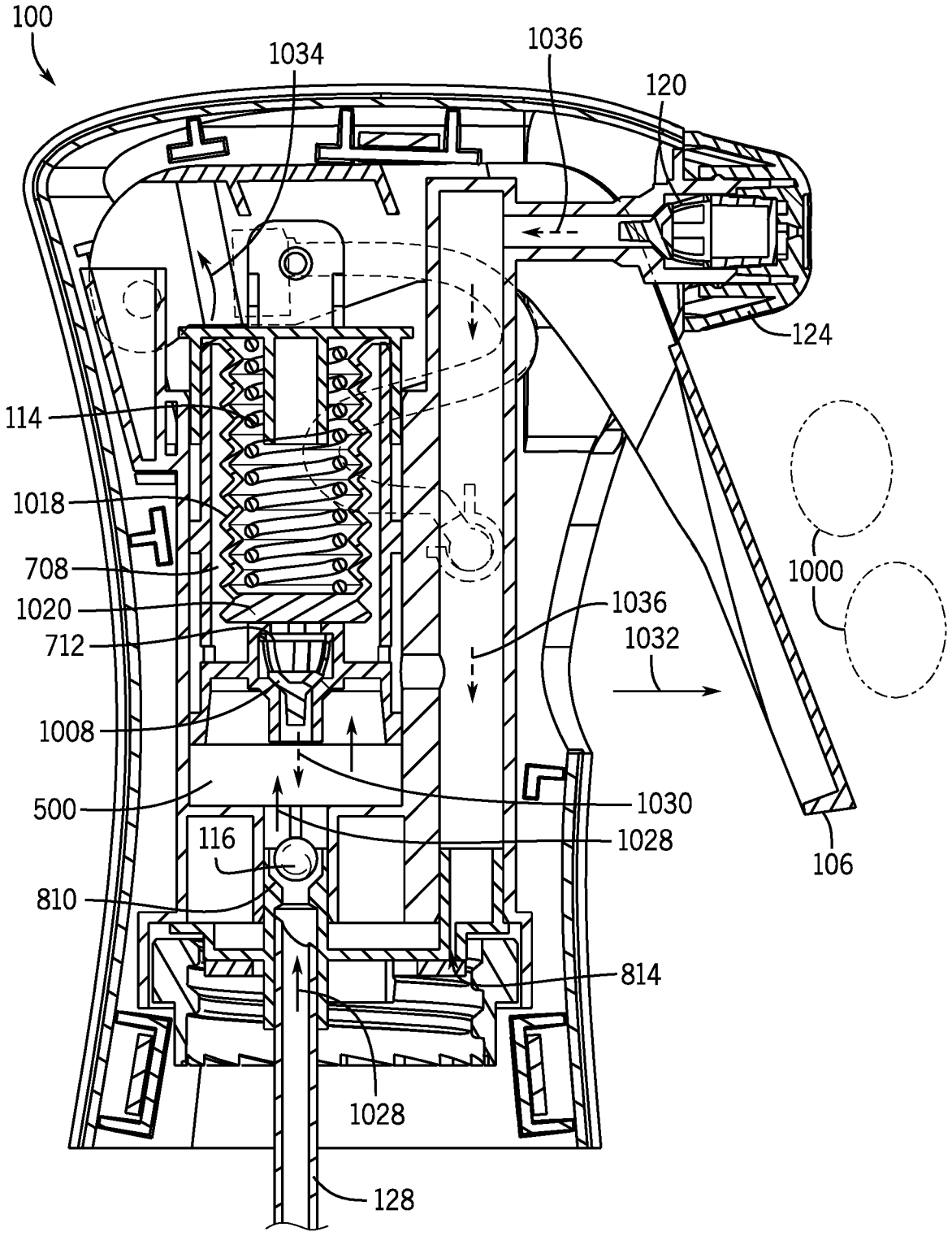
FIG. 10D is another side cross-sectional view of the trigger sprayer assembly depicting a flow of fluid as the bellows component is fully relaxed from the compressed position.

FIGS. 10A-10D depict side cross-sectional views of the trigger sprayer assembly 100 as an actuation cycle occurs. Specifically, FIG. 10A depicts the trigger sprayer assembly 100 in a neutral or relaxed position prior to application of an actuating force, FIG. 10B depicts the trigger sprayer assembly 100 in a depressed or actuated position during application of the actuating force, FIG. 10C depicts the trigger sprayer assembly 100 returned to the neutral or relaxed position upon removal of the actuating force while the relaxation of the bellows component 112 continues to drive spray through the nozzle 124, and FIG. 10D depicts the trigger sprayer assembly 100 after the bellows component 112 has returned to a fully relaxed or uncompressed position and spray through the nozzle 124 has stopped.

As specifically depicted in FIG. 10A, many of the fluid inlet and piston components (e.g., the dip tube 128, input valve 116, piston component 104, piston valve 118, bellows component 112, bellows spring 114) are arranged such that their centers coincide on the same vertical axis 1050, while the center of the vertically-oriented fluid outlet passage 502 is located on a vertical axis 1052 that is parallel to and spaced apart from the vertical axis 1050. By arranging the components of the trigger sprayer assembly 100 in this way with the nested piston and bellows chambers, the total volume of the trigger sprayer assembly 100 is advantageously minimized as compared with trigger sprayer assemblies in which one or more of the fluid inlet passage, the piston chamber, and the chamber capturing the fluid for extended spray are spaced apart from each other. For example, in an exemplary embodiment, the trigger sprayer assembly 100 can be used with a standardized fluid container having a 28 mm diameter opening. By contrast, existing continuous spray trigger assemblies require a fluid container having at least a 33 mm diameter opening.

Referring now to FIG. 10B, when a user positions their fingers 1000 against the trigger lever 106 and applies an actuating force represented by arrow 1002 to move the trigger lever 106 from the neutral position to the actuated position, the trigger lever 106 pivots downwardly, as depicted by arrow 1024. Compression of the S-shaped trigger springs 408 of the trigger lever 106 cause the piston component 104 to be driven downwardly, thereby decreasing the volume within the piston chamber 500. This decrease in volume causes fluid flow represented by arrow 1004 to move the piston valve 118 from a closed position to an opened position.

Piston valve 118 is shown to include a solid plug portion 1006 and a conical seat portion 1008. Multiple flexible members 1010 are radially distributed about an outer periphery of the conical seat portion 1008 and terminate in a ring-shaped member 1012. Fluid pressure forces the plug portion 1006 to travel upwardly within the piston valve structure 712. The travel of the plug portion 1006 causes the members 1010 to flex or bulge outwardly, moving the conical seat portion 1008 away from its seated position within the piston 104, permitting fluid to flow as indicated by arrow 1014 around the flexible members 1010 and into the bellows chamber 708.

Flow into the bellows chamber 708 causes the bellows component 112 and the bellows spring 114 to move from an uncompressed position (see FIG. 10A) to a fully compressed position (see FIG. 10B), thereby maximizing the available fluid volume within the bellows chamber 708. The bellows component 112 is shown to include an upper flange 1016 that is sandwiched between the piston coupler 108 and the piston component 104, as well as an accordion-shaped compressible sidewall 1018 that extends downwardly from the upper flange 1016. The sidewall 1018 terminates in a base portion 1020. When the bellows component 112 and the bellows spring 114 are in the uncompressed position (see FIG. 10A) the base portion 1020 may be seated against the piston valve structure 712. Flow into the bellows chamber 708 causes the base portion 1020 to lift off of the piston valve structure 712 and the sidewall 1018 and bellows spring 114 into a compressed position.

As soon as fluid begins to flow into the bellows chamber 708 of the piston 104, a portion of the fluid indicated by arrow 1022 exits the piston 104 via the circumferential piston outlets 706 and flows into the piston outlet passage 522. The fluid then flows upwardly through the vertically-oriented outlet chamber 502 and into the horizontally-oriented outlet chamber 504. Pressure from the fluid flow 1022 against the nozzle valve 120 located in the nozzle component 124 forces the nozzle valve 120 to deform in the same manner as the piston valve 118 to permit the flow of fluid past the nozzle valve 120. If the nozzle component 124 has been rotated to an opened position, the fluid flow 1022 exits the trigger sprayer assembly 100 through the water jacket 122 and the nozzle component 124.

In various embodiments, the liquid output per actuation of the trigger lever 106 is at least 1.0 cubic centimeters (CC). In an exemplary embodiment, the liquid output per actuation of the trigger lever 106 is at least 1.3 CC, with each actuation providing a spray output of at least two seconds. The actuation force to achieve this liquid output is preferably between 65 and 75 N. Three or four actuations of the trigger lever 106 may be required to draw fluid up the dip 128 and open the input valve 116.

As shown in FIG. 10C, when a user removes their fingers 1000 from the trigger lever 106, the S-shaped trigger springs 408 cause the trigger lever 106 to rebound from the actuated position to the neutral position in the direction represented by the arrow 1032, and the trigger lever to pivot upwardly, as represented by arrow 1032. The coupling of the trigger lever 106 and the piston component 104 via the piston coupler 108 pulls the piston component 104 upwardly in the piston chamber 500, creating a vacuum that draws fluid into the piston chamber 500 as indicated by the arrow 1028. The fluid flowing in the direction of arrow 1028 flows through the dip tube 128 and forces the input ball valve 116 to travel upwardly such that the ball valve 116 is lifted off its seat 810, thus permitting fluid to flow past the ball valve 116 and refill the piston chamber 500. Since the piston 104 is moving upwardly at this time, the lack of pressure against the conical seat portion 1008 of the piston valve (indicated by arrow 1030) causes flow into the bellows chamber 708 to be arrested.

Once flow into the bellows chamber 708 is arrested, the compression of the bellows sidewall 1018 and the spring component 114 ceases. Potential energy stored in the spring component 114 pushes against the base portion 1020 and causes the sidewall 1018 of the bellows component to expand. This expansion forces the fluid within the bellows chamber 708 out of the piston 104 via the circumferential piston outlets 706, as indicated by arrow 1022. The fluid flows through the piston outlet passage 522, before traveling upwardly through the vertically-oriented outlet chamber 502, and out of the nozzle 124 after passing through the horizontally-oriented outlet chamber 504. As explained above, the flow indicated by arrow 1022 continues due to the relaxation of the bellows for at least two seconds after the user has stopped actuating the trigger lever 106.

Referring now to FIG. 10D, the base portion 1020 of the bellows is seated against the piston valve structure 712, arresting the flow of fluid out of the bellows chamber 708 and the piston 104. In the absence of the motive force provided by the fluid exiting the bellows chamber 708, the fluid represented by arrow 1036 does not exert sufficient pressure against the nozzle valve 120 to maintain the valve in an opened position, thus causing the flow from the nozzle 124 to cease. The fluid represented by arrow 1036 flows downwardly through the drainage passage 814, thus returning to the fluid container in preparation to be drawn back upwardly to the trigger sprayer assembly 100 via the dip tube 128. Accordingly, FIGS. 10A-10D depict a full stroke of the trigger lever 106 and a full cycle in the process of discharging and refilling the piston chamber 500 and the bellows chamber 708.

The different systems and methods described herein may be used alone or in combination with other systems and devices. Various equivalents, alternatives and modifications are possible within the scope of the appended claims.

What is claimed is:

1. A trigger sprayer assembly for dispensing a fluid, comprising:

an engine comprising a piston chamber and an outlet fluid passage that is fluidly coupled to the piston chamber;

a piston that is slidably disposed within the piston chamber, the piston defining an interior bellows chamber;

a bellows component disposed within the interior bellows chamber, the bellows component movable between an uncompressed position in which an available fluid volume in the interior bellows chamber is minimized and a compressed position in which the available fluid volume in the interior bellows chamber is maximized;

a trigger lever coupled to the engine and the piston using a pair of S-shaped trigger springs, the trigger lever configured to pivot between a neutral position and an actuated position;

wherein pivotal movement of the trigger lever from the neutral position to the actuated position pushes the piston vertically in the piston chamber to drive fluid from the piston chamber into the interior bellows chamber and move the bellows component from the uncompressed position to the compressed position; and wherein relaxation of the bellows component from the compressed position to the uncompressed position drives fluid from the interior bellows chamber to the outlet fluid passage.

2. The trigger sprayer assembly of claim 1, wherein the piston comprises a cylindrical sidewall with a plurality of piston outlets formed in a radial pattern therethrough, wherein the fluid traveling from the interior bellows chamber to the outlet fluid passage passes through the plurality of piston outlets.

3. The trigger sprayer assembly of claim 1, wherein the engine further comprises an inlet fluid passage that is fluidly coupled to the piston chamber.

4. The trigger sprayer assembly of claim 3, wherein pivotal movement of the trigger lever from the actuated position to the neutral position pulls the piston vertically in the piston chamber to cause fluid to flow from the inlet fluid passage into the piston chamber.

5. The trigger sprayer assembly of claim 3, further comprising a dip tube extending from a first end to a second end, wherein the first end is coupled to the inlet fluid passage and the second end is positioned within a fluid container.

6. The trigger sprayer assembly of claim 5, wherein a dip tube centerline passing through a center of the dip tube is coincident with a piston centerline passing through a center of the piston.

7. The trigger sprayer assembly of claim 6, further comprising a piston valve configured to control unidirectional fluid flow from the piston chamber to the interior bellows chamber.

8. The trigger sprayer assembly of claim 7, wherein a piston valve centerline passing through a center of the piston valve is coincident with the dip tube centerline and the piston centerline.

9. The trigger sprayer assembly of claim 6, wherein an outlet centerline passing through a center of a vertical portion of the outlet fluid passage is offset from and parallel to the piston centerline.

10. The trigger sprayer assembly of claim 1, wherein each of the pair of S-shaped trigger springs comprises a first curved portion having a first radius of curvature and a second curved portion with a second radius of curvature, wherein the first radius of curvature is larger than the second radius of curvature.

11. The trigger sprayer assembly of claim 1, wherein the bellows component comprises:

an upper flange configured to couple to the piston; and a compressible sidewall extending downwardly from the upper flange and terminating in a base portion, wherein the compressible sidewall and the base portion define a sealed bellows region.

12. The trigger sprayer assembly of claim 11, further comprising a bellows spring disposed within the sealed bellows region, wherein the bellows spring is configured to exert a spring force against the base portion to aid in the relaxation of the bellows component from the compressed position to the uncompressed position.

13. The trigger sprayer assembly of claim 1, wherein the bellows component is fabricated from a resilient thermoplastic elastomer material.

14. A trigger sprayer assembly for dispensing a fluid, comprising:

an engine comprising a piston chamber and a fluid passage that is fluidly coupled to the piston chamber, the fluid passage extending from an inlet portion to an outlet portion;

a piston that is slidably disposed within the piston chamber, the piston defining an interior bellows chamber;

a bellows component disposed within the interior bellows chamber, the bellows component movable between an uncompressed position in which an available fluid volume in the interior bellows chamber is minimized and a compressed position in which the available fluid volume in the interior bellows chamber is maximized;

a trigger lever coupled to the engine and the piston, the trigger lever configured to pivot between a neutral position and an actuated position;

an input valve configured to control unidirectional fluid flow from the inlet portion to the piston chamber;

a piston valve configured to control unidirectional fluid flow from the piston chamber to the interior bellows chamber; and an output valve configured to control unidirectional fluid flow through the outlet portion;

wherein pivotal movement of the trigger lever from the neutral position to the actuated position pushes the piston vertically in the piston chamber to drive fluid from the piston chamber through the piston valve into the interior bellows chamber and move the bellows component from the uncompressed position to the compressed position; and wherein relaxation of the bellows component from the compressed position to the uncompressed position drives fluid from the interior bellows chamber to the outlet portion and through the output valve.

15. The trigger sprayer assembly of claim 14, wherein at least one of the input valve, the piston valve, and the output valve comprises:

a plug portion;

a conical seat portion extending from the plug portion; and a plurality of flexible members radially distributed about and extending from an outer periphery of the conical seat portion; the plurality of flexible members terminating in a ring member;

wherein the plurality of flexible members are configured to deform to permit a flow of fluid past the plurality of flexible members.

16. The trigger sprayer assembly of claim 14, wherein the input valve comprises a ball valve.

17. The trigger sprayer assembly of claim 14, further comprising a nozzle coupled to the engine, wherein rotating the nozzle relative to the engine is configured to modify a spray pattern of fluid exiting the output valve.

18. The trigger sprayer assembly of claim 17, wherein the output valve is located at least partially within the nozzle.

19. A method of dispensing fluid from a trigger sprayer assembly, the method comprising:

pulling a trigger lever toward a rear end of the trigger sprayer assembly, wherein the trigger lever pushes a piston vertically in a piston chamber to drive fluid from the piston chamber through a piston valve into an interior bellows chamber formed in the piston;

in response to pulling the trigger lever, moving a bellows component disposed in the interior bellows chamber from an uncompressed position to a compressed position;

releasing the trigger lever toward a front end of the trigger sprayer assembly; and in response to releasing the trigger lever, relaxing the bellows component from the compressed position to the uncompressed position to drive fluid from the interior bellows chamber to an outlet fluid passage.

20. The method of claim 19, wherein releasing the trigger lever toward the front end of the trigger sprayer assembly pulls the piston vertically in the piston chamber to cause fluid to flow from an inlet fluid passage into the piston chamber.

* * * * *